US007513533B2

(12) United States Patent
Nellis

(10) Patent No.: US 7,513,533 B2
(45) Date of Patent: Apr. 7, 2009

(54) COMBINATION STAMP AND ADVERTISING BOOKLET

(75) Inventor: Robert Nellis, Cape Coral, FL (US)

(73) Assignee: Postage Stamp Advertising, Inc., Cape Coral, FL (US)

( * ) Notice: Subject to any disclaimer, the term of this patent is extended or adjusted under 35 U.S.C. 154(b) by 0 days.

(21) Appl. No.: 11/353,329

(22) Filed: Feb. 13, 2006

(65) Prior Publication Data

US 2007/0187945 A1 Aug. 16, 2007

(51) Int. Cl.
*G09F 3/00* (2006.01)
*B42D 15/00* (2006.01)

(52) U.S. Cl. ..... 283/71; 283/81; 283/56

(58) Field of Classification Search ..... 281/3.1, 281/15.1, 29, 31, 36–38, 42, 45, 51; 283/81, 283/63.1, 64, 64.1, 51, 56, 71; 402/79; 428/354
See application file for complete search history.

(56) References Cited

U.S. PATENT DOCUMENTS 231,365 A * 8/1880 Small ..... 283/71
462,328 A * 11/1891 Beed et al. ..... 283/51
470,861 A 3/1892 Chichester
526,121 A * 6/1894 Toland et al. ..... 281/3.1
619,054 A 3/1899 Strauss et al.
938,910 A 11/1909 Sultzer
2,215,163 A * 9/1940 Shedd ..... 281/43
3,718,348 A 2/1973 Bellanca
3,807,771 A 4/1974 Greason
3,995,741 A 12/1976 Henderson
4,305,605 A 12/1981 Vine
4,307,900 A * 12/1981 Krautsack ..... 283/56
4,492,390 A 1/1985 Jacobs et al.
4,676,526 A 6/1987 Redman
4,770,322 A 9/1988 Slota et al.
4,795,195 A 1/1989 McClain, Jr.
5,219,183 A * 6/1993 McKillip ..... 283/62
5,248,280 A * 9/1993 Lockwood et al. ..... 462/19
5,308,120 A 5/1994 Thompson
5,344,190 A 9/1994 Volz
5,501,491 A 3/1996 Thompson
5,503,436 A 4/1996 Alpaugh et al.
5,727,817 A * 3/1998 Kraige ..... 283/51
6,062,603 A 5/2000 Rich et al.
6,099,043 A * 8/2000 Story ..... 283/99
6,217,078 B1 * 4/2001 Roth et al. ..... 283/81
6,482,510 B1 * 11/2002 Rajan et al. ..... 428/349
6,656,555 B1 * 12/2003 McKillip ..... 428/40.1
2003/0186014 A1 * 10/2003 McKillip ..... 428/40.1
2005/0170127 A1 8/2005 Whitmond et al.

* cited by examiner

*Primary Examiner*—Dana Ross
*Assistant Examiner*—Pradeep C Battula
(74) *Attorney, Agent, or Firm*—McHale & Slavin, P.A.

(57) ABSTRACT

The present invention is directed toward a combination stamp and advertising booklet. Particularly, a combination postage stamp and advertising booklet having dimensions of paper currency so that it can be readily placed in the till of a check-out register for easy dispensing thereof by the cashier. Each page of the booklet may include one or more removably attached stamps and one or more forms of advertisement, thereby exposing the potential customer accessing the stamps to the advertising material located on the page and adjacent pages. This configuration minimizes the risk that the advertising material will be overlooked or discarded by the consumer.

7 Claims, 2 Drawing Sheets

COMBINATION STAMP AND ADVERTISING BOOKLET

FIELD OF THE INVENTION

This invention is directed toward a combination stamp and advertising booklet. Particularly, a combination postage stamp and advertising booklet having dimensions of paper currency so that it may be readily placed into the till of a checkout register for easy dispensing thereof by the cashier.

BACKGROUND OF THE INVENTION

Typically postage stamps are available to the consumer as a sheet or roll of removable stamps for use with a stamp dispensing means, or booklets containing a set of one or more folded arrays of stamps, usually forming a 2×2 inch booklet. Smaller and easier to handle than a whole sheet or roll of stamps, in many countries booklets have become a favored way to purchase stamps.

For enhanced customer convenience, grocery stores and other similar retailers often sell postage stamps at the checkout registers. Bulky rolls and the small booklets do not typically fit within the currency sized tills of a conventional register, making them difficult to store and remove quickly therefrom.

It is common practice for advertisers to distribute advertising material including sophisticated promotional tools, such as coupons and fliers onto everyday materials. Coupons are a time-tested and proven marketing vehicle for increasing product sales. Coupons can lead to multiple purchases and repeat customers.

Advertising and discount coupons are commonly found in newspaper and magazine supplements; sometimes websites, fliers, handbills and receipts include coupons. However, over the years consumers have become complacent to the advertising and coupon craze. This forces businesses to invent creative marketing techniques designed to reach the consumer with their products or services. Attaching advertising means, such as coupons to products and services not characteristically associated with such advertisements is an opportunity to standout and reach new customers.

Due to the large number of persons who typically purchase postage stamps, stamp booklets represent an excellent and unique medium for advertising goods and services. A booklet that may include, on plural intermediate pages, removably attached postage stamps, which necessitate exposure of plural advertisement placements, for example on same and facing pages, to potential customers, while accessing the postage stamps. This configuration minimizes the risk that the advertising material will be overlooked or discarded by the consumer.

DESCRIPTION OF THE PRIOR ART

Patents that have been directed toward the combination of a booklet or mailer having coupons or advertisements in combination with removable stamps or labels are illustrated herein.

For example, U.S. Pat. No. 619,054 discloses a label-holding book. The device includes folding a moisture-proof cover having bound therein a series of gummed label sheets, a series of non-adhesive sheets facing the gummed side for the label sheets, and a series of advertising sheets facing the non-adhesive side of the label sheets. The labels are preferably separated by a line of perforations or alternatively may include ruled lines to indicate the lines of separation.

U.S. Pat. No. 4,795,195 to McClain Jr. discloses a booklet comprising a discount coupon and stamp holder. On the inside portion of the front cover is attached a conventional book of postage stamps purchased from various sources for the face value of the postage stamps in the book. A plurality of perforated pages having discount coupons attached comprises the remainder of the booklet. Unlike the instant invention, the stamps are not located on the same page as the advertising; thus, the consumer is able to access the stamps while potentially overlooking or disregarding the advertisements contained therein. In addition, the McClain reference discloses the perforations that are formed along the upper portion of the page, such that when the consumer uses the coupon the entire page is removed from the booklet; this indicates to the user when to purchase another booklet. As evidenced by the fact that the entire coupon page is removed upon use, this patent fails to recognize the advantages of combining the promotional material and stamps on the same page.

U.S. Pat. No. 5,344,190 to Volz discloses a combination printed sheet and stamps that may be a direct mailer or a book of stamps comprising a sheet of imprintable material of substantially uniform thickness and including a first or stamp portion and a second self-mailer or stamp book cover portion, an adhesive coating on one side of the sheet and printed indicia on the other side thereof. The second portion of the sheet is foldable along a medial fold line to position the two segments thereof into superposed relation and the adhesive coating can be activated to secure the segments together to provide the thickness and stiffness necessary for the second portion to serve as a self-mailer or as a stamp book cover.

U.S. Pat. No. 5,501,491 and U.S. Pat. No. 5,308,120, both to Thompson disclose a peel off coupon redemption card and tracking system. The coupon redemption card and tracking system include a credit card size redemption coupon card used by the customer, and a tracking sheet used by the redemption center such as a restaurant. The redemption card has a plurality of mini coupons, which can be peeled off individually. Each redeemed coupon is affixed to the tracking sheet, which has dimensions of a dollar bill so that it can be placed in the till of a cash register. The tracking system facilitates the accounting and inventory of redeemed coupons. The coupon card is formed as two laminated layers of special paper joined together by a layer of adhesive material, and a layer of clear plastic film on the top face of the card. The base layer is fabricated from a special paper. An adhesive coating is applied to one side of the base layer. The peel off coupon layer is affixed to the adhesive coating. The finished layered sheet is printed on both sides, die-cut on the coupon side, and then laminated with the film on the other side. Each coupon that is removed from the card has adhesive to adhere the coupon to the tracking sheet. The small size of the mini coupons is convenient for the card holder and the redemption center. It eliminates the need to process diverse sizes and shapes of customer coupons. The system can be used wherever one has to keep track of various redeemable coupons.

U.S. Pat. No. 5,503,436, to Alpaugh et al., discloses an ATM dispensable self-adhesive postage stamp construction. The article of manufacture includes a sheetlet consisting of an array of postage stamps adhered by an ooze resistant pressure sensitive adhesive to a continuous release liner of currency size. The stamps comprising paper facestock are of a paper weight of about 56 gm/m$^2$ having an upper and lower surface. The upper surface is printed with stamp graphics and coated having a surface coefficient of friction greater than 0.45. The coating preferably contains Taggant with an imprintable polymeric coating. The lower surface is coated with a water soluble primer. The water soluble primer is in contact with ooze resistant pressure sensitive adhesive, which is, in turn, in contact with the release liner that has an undercoating.

U.S. Patent Publication No. 2005/0170127, to Whitmond et al., discloses a foldable stamp sheet that includes a backing sheet, at least one label on the sheet, the label having an adhesive backing that allows it to adhere to the backing sheet in a non-permanent manner. Each label includes a scored section along a midline of the label and at least one stamp is printed on each label. Pull tabs are positioned on the sheet in areas to allow the sheet to be folded when they are removed.

U.S. Pat. No. 4,305,605, to Vine, discloses a soft cover and coupon insert for paperback books and a method for making the same. The cover and insert are printed on both sides of a sheet of paper material. The printed sheet is folded in half on a terminal end fold line and bonded together on spine receiving portions, which separate the front and back portions of the cover and coupon insert. The front cover portion is separated from the coupon insert portion by severing along a cut line positioned a sufficient distance from the terminal end fold line.

Unlike the present invention, all of the aforementioned prior art include adhesive labels or stamps that utilize the entire page for attachment thereof. In these prior art devices, the stamps could be easily accessed or even removed, without necessitating viewing of the advertising. On the contrary, in the present invention, in order to access or remove the stamps, the consumer must be exposed to advertisements and/or coupons that are printed on the same, adjacent or oppositely positioned pages. The booklets of the present invention are sized for placement within a paper currency compartment of a standard cash register drawer and sold upon request for a booklet of stamps. After purchase the user must review each page of the booklet to remove a stamp therefrom.

SUMMARY OF THE INVENTION

Accordingly, it is an objective of the instant invention to provide a combination stamp and advertising booklet for use in participating retail establishments. The booklet comprising a cover means providing a front and back page and a plurality of intermediate pages integrally connected along at least one side edge to the cover means, each intermediate page having a first portion to which at least one conventional postage stamp is removably attached and the remaining second portion of the page includes at least one discount coupon or other form of advertising. Advertising, in accordance with the present invention, is understood to include generic forms of advertising such as coupons, rebates, free offers, and the like, as well as public service announcements.

It is a further objective of the instant invention to provide a booklet having dimensions of paper currency so that it can be readily placed in the till of a checkout register for easy dispensing thereof by the cashier.

It is yet another objective of the instant invention to provide a construction that effectively exposes the user removing stamps from a booklet page to view the advertising material (e.g., coupons, fliers) located on the same page.

It is a still further objective of the invention to provide a booklet that is economical to manufacture as it essentially utilizes all available space.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Figure 1:
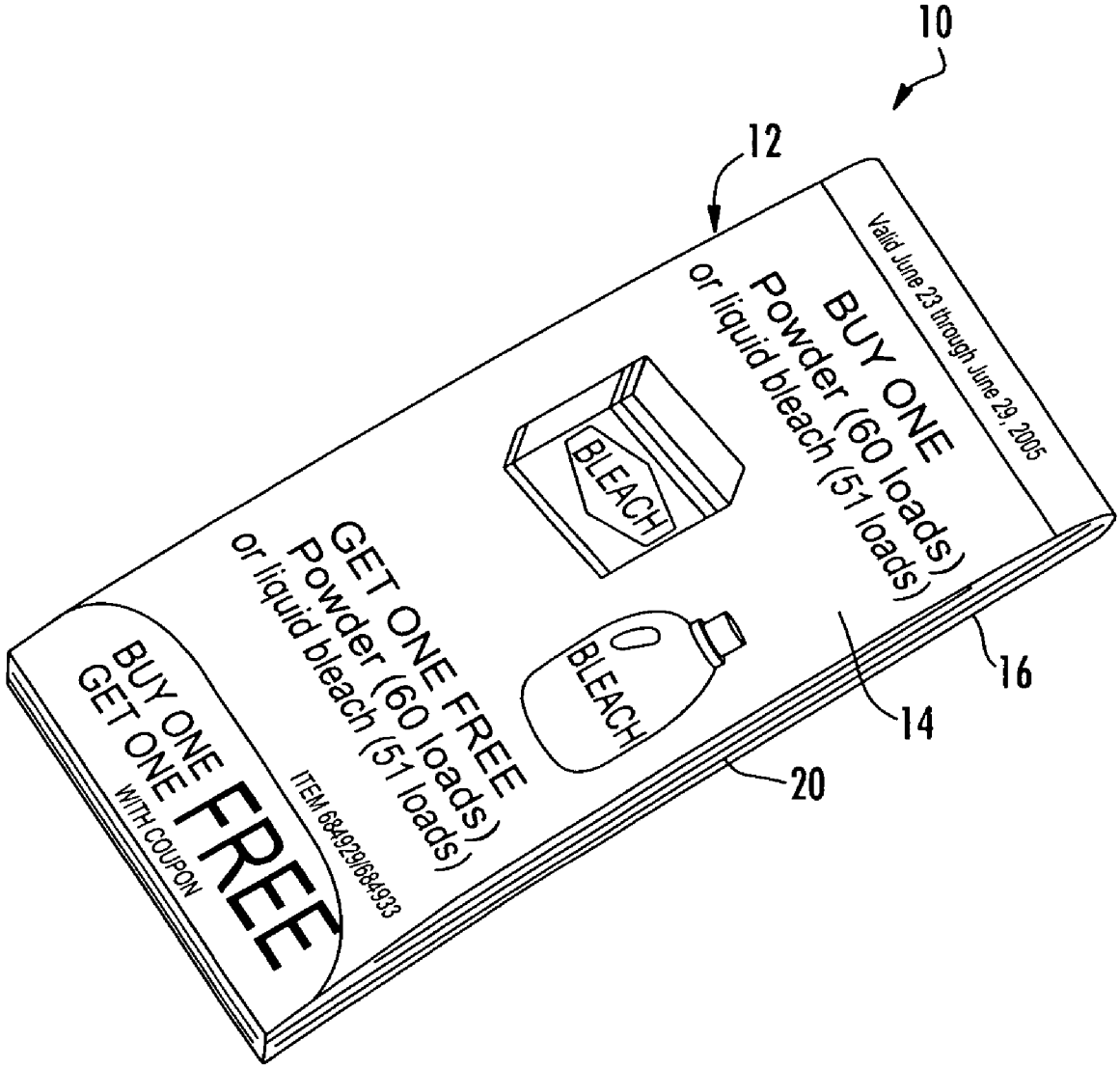
FIG. 1 is an isometric view of the combination stamp and advertising booklet of the present invention showing the top of the front cover.
Figure 2:
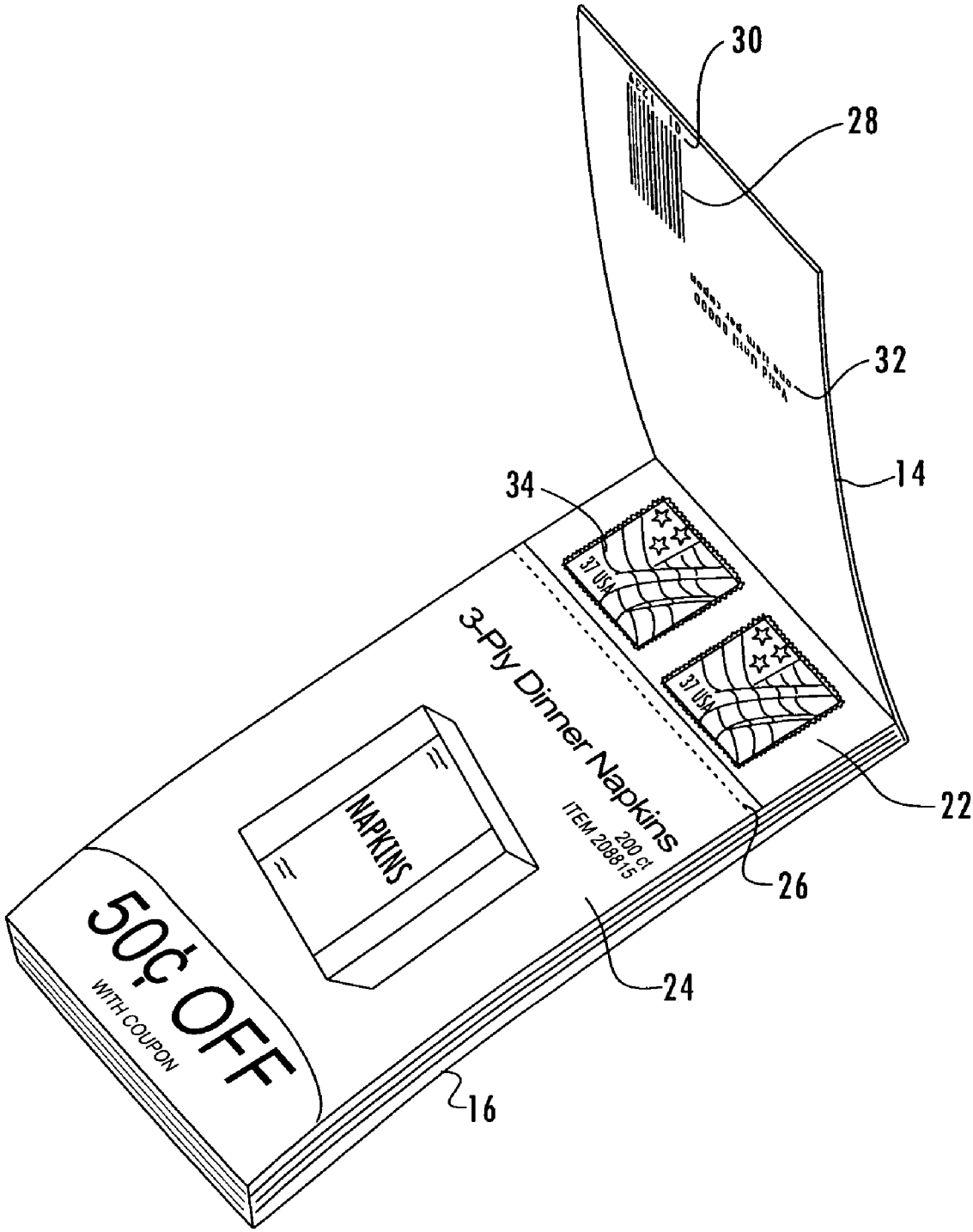
FIG. 2 is an isometric view showing the booklet of the present invention with the front cover open to show the attached interior pages that includes a first portion and a second portion.

Referring now to FIGS. 1-2, wherein like elements are numbered consistently throughout, FIG. 1 shows an isometric view of the stamp and discount advertising booklet of the present invention for use in retail establishments, generally referenced as 10, according to a preferred embodiment of the present invention. The booklet comprises a cover means 12 providing a front page 14 integrally connected to a back page 16 with a plurality of intermediate pages 20 located therebetween. Preferably, the booklet 10 is constructed and arranged, such that, when the front and back cover are superimposed the booklet is approximately the size of paper currency. This configuration allows for the booklet to be readily placed into the till of a checkout register for easy storage and dispensing thereof by the cashier upon request by the consumer.

It is herein contemplated that the cover means may be constructed from a heavier material than that used for the intermediate pages 20 thereby making the booklet 10 more robust for use for an extended period of time. The type and quality of material used to manufacture the booklet 10 may vary according to the manufacture's needs.

In a preferred embodiment, illustrated in FIG. 2, the front page 14 can comprise at least one advertising means printed thereon in a conventional fashion. This arrangement maximizes essentially all available advertising space available in the booklet. Similarly, although not shown, the back page 16 may comprise at least one advertising means.

Each of the aforementioned booklet pages 20 are attached to the cover means along at least one side edge between the front and back page. The intermediate pages 20 may be attached to the cover means by any means of attachment known to those having skill in the art, including, albeit not limited to, staples, adhesives, or combinations thereof.

Each intermediate page 20 includes a first portion 22 and a second portion 24, which constitutes the remainder of the page. The first portion includes any means of removably affixing at least one conventional postage stamp 34 thereto, for example, an adhesive release agent or a small strip of backing material. The release agent may be applied using standard printing equipment; alternatively, the backing strip is adhesively applied to each page using a specialized piece of equipment in combination with the standard printing equipment.

The second portion comprises at least one advertisement means printed thereon. Examples of advertisement means include, manufacturer or retailer discount coupons, coupon cards, or the like.

In one embodiment each of the plurality of pages can be perforated 26 between the first and second portion 22, 24 for easy separation. Alternatively the area between the first and second portion can include ruled lines to indicate the lines of separation along which the user will cut to separate the second portion.

Although not shown, it is likewise contemplated herein that the second portion could contain multiple coupons or forms of advertising, in which the second portion 24 of the page can include perforations or ruled lines between the first and second portion and between the multiple discount coupons to allow for the removal thereof while the first portion remains attached to the cover means. This configuration allows the user to remove coupons as desired while the stamps remain in the booklet until needed by the user. It is herein noted that neither the multiple forms of advertising, nor the stamps themselves need be on only one side of the page. It is contemplated that both sides of each page may be printed and contain stamps thereon.

Moreover, the second portion of each of the plurality of pages can include printed indicia such as a bar code 28, unique identification indicia (e.g., item number) 30, and redeeming instructions 32 including validity dates or the like.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A paper currency-sized stamp and advertising booklet for use in retail establishments, said booklet comprising in combination:

(a) a cover means providing a front page integrally connected to a back page; and (b) a plurality of intermediate pages, each intermediate page attached to said cover means along at least one side edge positioned between said front and said back page, each of said plurality of intermediate pages having a first side and a second side, and each page having a first portion, onto which at least one conventional postage stamp is removably attached, said at least one postage stamp representing payment of postal charges which when affixed to an item permits the item to be sent via the U.S. Postal Service to a location, said first portion includes a separate strip of backing material secured to said first portion, one side of said backing material contains an adhesive release agent onto which said at least one postage stamp is removably attached and a second portion which constitutes the remainder of said intermediate page and comprises at least one advertisement means and does not contain an adhesive release agent or removable stamp affixed to said second portion;

whereby said front page and said back page are constructed and arranged to fold along said integral connection in superimposed relation to produce said paper currency-sized booklet.

2. The stamp and advertising booklet as set forth in claim 1, wherein each of said plurality of intermediate pages is perforated between said first portion and said second portion to allow for removal of at least one discount advertisement while said first portion remains attached to said cover means.

3. The stamp and advertising booklet as set forth in claim 1, wherein said front page and said back page comprise at least one advertisement means to maximize advertising space.

4. The stamp and advertising booklet as set forth in claim 3, wherein said advertisement means comprises a discount coupon for redemption for a good or service.

5. The stamp and advertising booklet as set forth in claim 1, wherein the second portion of each of the plurality of intermediate pages includes printed indicia comprising at least one member selected from the group consisting of a bar code, unique identification indicia, redeeming instructions or validity dates.

6. The stamp and advertising booklet as set forth in claim 1, wherein said advertisement means comprises a discount coupon for redemption for a good or service.

7. The stamp and advertising booklet as set forth in claim 1, wherein each side of said intermediate page contains at least one form of advertisement means.

* * * * *